United States Patent [19]

MacGregor et al.

[11] 3,982,643

[45] Sept. 28, 1976

[54] POWER LOADER

[75] Inventors: William Roderick MacGregor; Dalton Harold Spicer, both of Welland, Canada

[73] Assignee: Deere & Company, Moline, Ill.

[22] Filed: June 30, 1975

[21] Appl. No.: 591,353

[52] U.S. Cl. ..... 214/131 A; 56/15.6; 172/273

[51] Int. Cl.[2] ..... E02F 3/72

[58] Field of Search ..... 214/131 A, 140; 172/272, 273, 274, 275; 56/15.6

[56] References Cited

UNITED STATES PATENTS

| | | | |
|---|---|---|---|
| 2,608,042 | 8/1952 | Paul | 56/15.6 |
| 2,972,424 | 2/1961 | Cadwell | 214/131 A |
| 3,054,520 | 9/1962 | Maloney | 214/131 A |
| 3,815,687 | 6/1974 | Federspiel | 172/272 |

FOREIGN PATENTS OR APPLICATIONS

| | | | |
|---|---|---|---|
| 477,709 | 10/1951 | Canada | 172/273 |
| 1,020,473 | 12/1957 | Germany | 172/272 |

*Primary Examiner*—L. J. Paperner
*Assistant Examiner*—Ross Weaver

[57] ABSTRACT

A detachable front end loader for a tractor constructed to not only be easily mounted and demounted from a tractor, but to also be self-supporting when demounted. A loader frame having a rectangularly-shaped base rests level on the ground when demounted and is mounted flush with the tractor main frame when mounted. By a combination of expanding and contracting the hydraulic lift cylinder and moving the tractor ahead, the loader can be elevated into a mounted position beneath the tractor and secured thereto. Means for releasably fastening the loader to the tractor main frame are easily manipulated by the operator.

8 Claims, 9 Drawing Figures

FIG. 3
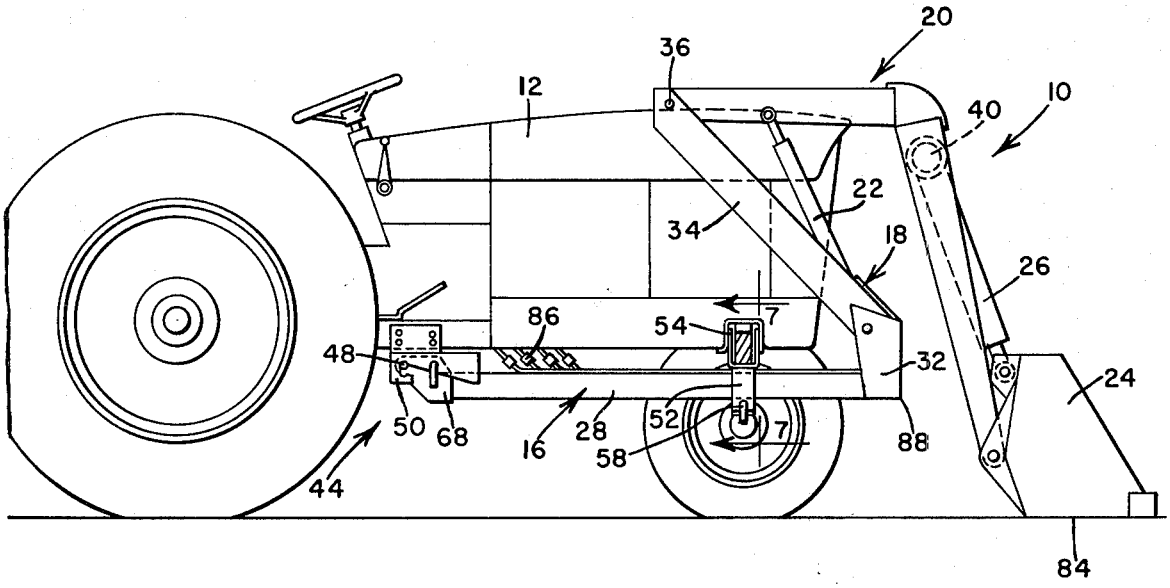
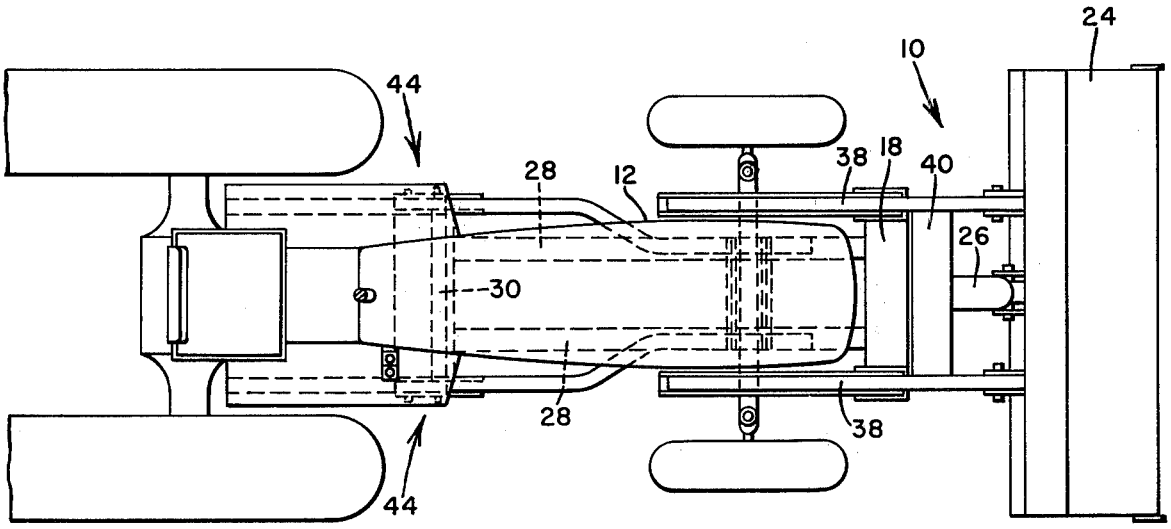
FIG. 4

POWER LOADER

BACKGROUND OF THE INVENTION

1. Field of the Invention

The present invention relates generally to power loaders adapted to be mounted on tractors and is more particularly concerned with quick attachment type loaders which are self-supporting when detached from a tractor.

2. Description of the Prior Art

Front end power loaders are today commonly used as attachments mounted on tractors. It is therefore desirable that such loaders be simple and easily mounted and detached and that the effort and time required for mounted or detaching be minimized.

In the past, power loaders were secured to tractors by means which required time consuming effort to mount and then subsequently detach each time the tractor was required for use other than with the loader. Such loaders were often bolted to the tractor frame, or in another form, mounting plates were first secured to the tractor and the loader then attached to the mounting plates. These methods not only resulted in excessive operator downtime, but also required that the operator have readily available whatever miscellaneous hand tools as might be necessary.

Storage of many detachable loaders was often accomplished by supporting the loader on a stand or other supplemental apparatus. Not only did this arrangement require that each loader be provided with its own stand, but in addition, whenever the operator wanted to store the loader or remove it temporarily, the loader had to be either transported to the location where the stand was or the stand had to be moved to the desired storage location. To align this type loader with the tractor during mounting or demounting required that the loader be supported. As a result, makeshift or temporary stands were often made, these stands were often unsteady and created an unsafe mounting or demounting situation. Similarly, these same stands were then used to store the loader, thereby causing an unsafe storage situation from which injuries could easily result.

Another type of loader apparatus provided for securing the loader to the sides of the tractor frame, alongside the engine compartment. This means of securing the loader to the tractor resulted in the transfer of those forces encountered while operating the loader to the tractor frame sides or top. Such loading can cause severe structural deformation to the tractor.

Another type of self-supporting loader apparatus utilizes the frame of the loader apparatus as both the supporting structure when mounted on the tractor and as a supporting stand when detached from the tractor. In this type of loader, the main frame is manipulated from a working position horizontal alongside the tractor to an inclined ground-engaging and self-supporting position. This manipulation is effected as the tractor moves relative to the frame by extending and retracting the hydraulic cylinders normally used for operating the implement and its supporting boom structure. With this type of self-supporting implement, it often is necessary for the hydraulic pistons to be extended for undetermined lengths of time wherein the pistons are adversely exposed to the elements and are therefore subject to accellerated corrosion and pitting.

The present invention provides a structure which requires little effort to mount or dismount it, and can be mounted or dismounted very quickly. No supplementary mounting plates, bolts, or tools are required, and one man can easily and simply perform the loader mounting or dismounting. No mounting plates or channels project from the tractor side or front.

The present structure requires no supplemental apparatus such as a stand for storage. The loader is stored with the frame level on the ground thereby avoiding unstable and unsafe storage situations. This permits mounting and dismounting of the loader to the tractor to be accomplished at any chosen site, by a single person or operator and without the use or necessity of providing additional or supplemental auxillary equipment such as stands or jacks.

The loader when mounted is attached to the tractor undercarriage and thereby transfers loading forces directly to the tractor main frame. Accordingly, a smaller tractor can be used with the loader and no structural damage will result to the tractor.

It is therefore highly desirable and an object of this present invention to provide a power loader having a frame or base which rests level with ground when dismounted and which is easily mounted to the undercarriage of the tractor.

It is further an object of the present invention to provide a stable support structure requiring no stands or other supplemental apparatus, such that upon receipt of an inadvertent bump when in a stored condition, the loader will maintain its stability.

Yet another object of the present invention is to provide means enabling one man to easily and simply attach the loader to the tractor undercarriage in a short time and without requiring any miscellaneous equipment or hand tools.

SUMMARY OF THE INVENTION

In accordance with the present invention, there is provided a loader having mounting apparatus for quick attachment and detachment to a tractor. The loader is adapted to be mounted on the tractor undercarriage from a resting or stored position on the ground by a combination of virtually labor-free operations. The loader frame is constructed such that the usual loader cylinder piston assemblies are used to raise the loader up to the bracket members carried by the tractor frame whereat releasable fastening means secure the loader in place.

BRIEF DESCRIPTION OF THE DRAWINGS

In the drawings which illustrate an embodiment of the invention:

FIG. 3 is a side view of the power loader mounted on the tractor.

FIG. 4 is a top view of the tractor and mounted loader illustrating in dotted lines the loader frame relationship to the tractor frame illustrated in solid lines.

DESCRIPTION OF THE PREFERRED EMBODIMENT

Figure 2:
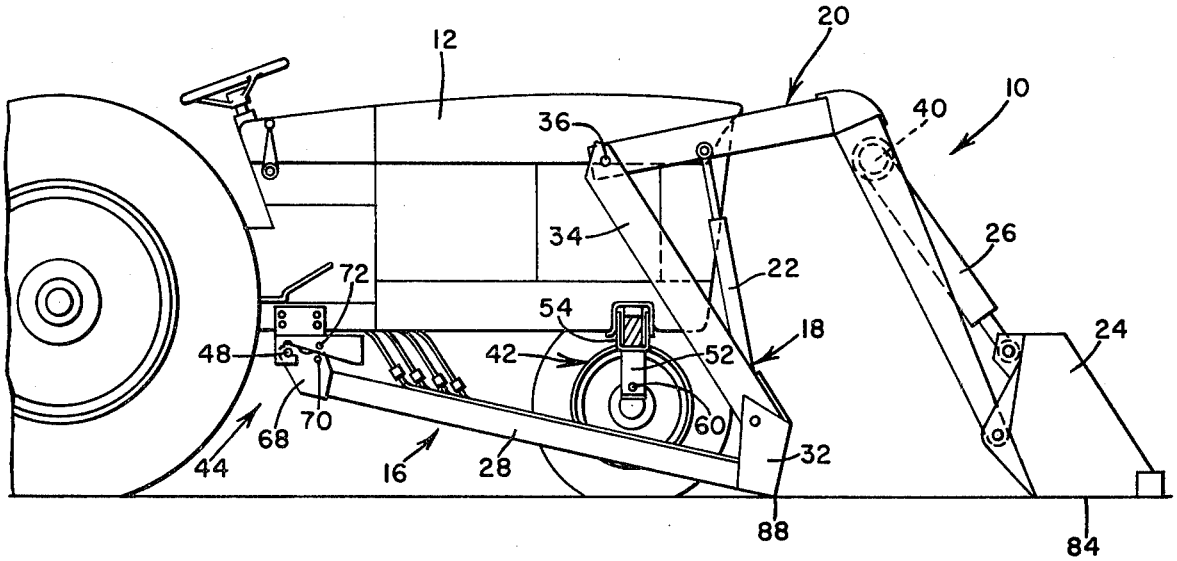
FIG. 2 is a side view of the power loader and tractor illustrating the loader in a partially mounted position.

Turning now to the embodiment illustrated in the drawings, there is generally shown at 10 a power loader for attachment to and detachment from a tractor 12. The power loader 10 is comprised generally of a frame 14 including a base 16 and a mast 18, a lift boom 20, a first power means 22 acting between the boom and frame, a working tool or bucket 24 mounted on the boom, a second power means 26 acting between the boom and working tool, and mounting apparatus between the tractor 12 and loader 10 for positioning the loader on the tractor and mounting and supporting the loader thereon.

Figure 1:
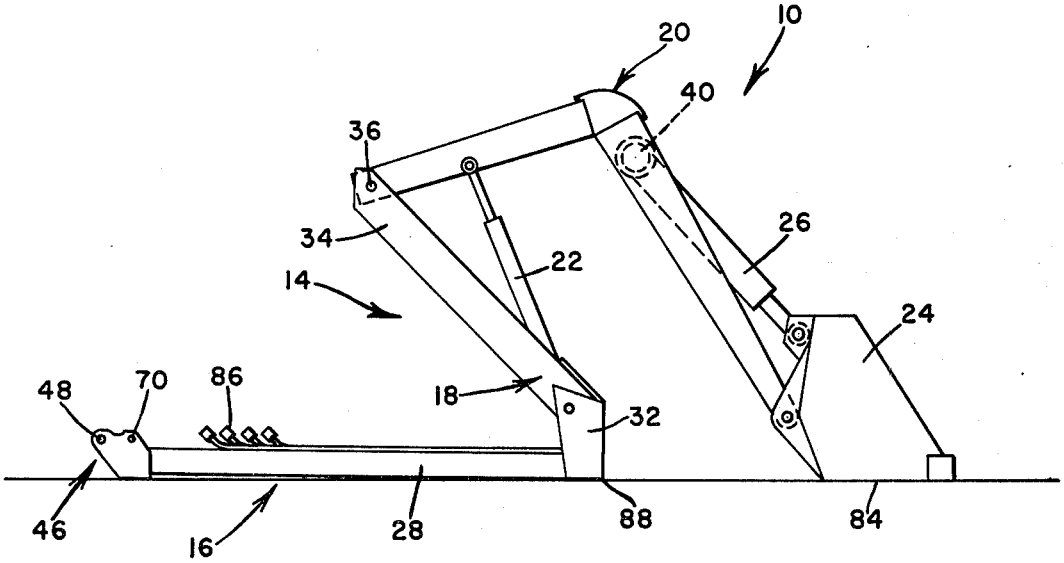
FIG. 1 is a side view of the power loader in a self-supporting parked position.
Figure 6:
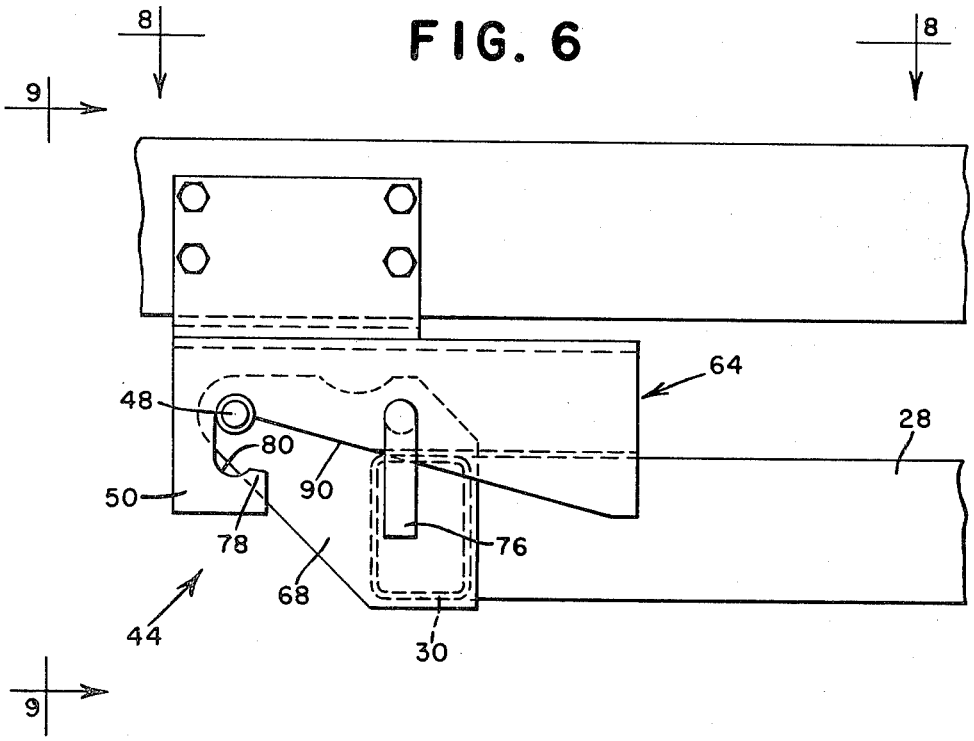
FIGS. 5 and 6 are enlarged fragmentary side views illustrating the rear mounting bracket and loader base rearwardly portion.

As can be seen in FIG. 1, the loader frame 14 is comprised of a base 16 secured to an upstanding mast 18. This base 16 includes two transversely spaced apart and fore-and-aft extending beams or members 28 for mounting the loader on the tractor and supporting it therefrom. Each member 28 also serves to cooperate with the bucket 24 in supporting the loader while it is in a parked or demounted position. Extending between the base members 28 at their rearwardly ends and secured perpendicular thereto is a cross member 30. Extending between and secured perpendicular to the base members 28 at their forwardly ends and comprising the mast base member is a second cross member 32. To this second cross member 32 are secured the upwardly and rearwardly extending side members or posts 34 which form the main part of the mast 18.

In FIG. 1, the loader is shown in a demounted and parked position with the base members 28 resting level on the ground and the bucket 24 resting flat on the ground. As can be seen from the drawings, no parking stand or parking legs are required.

To the upper ends of the mast posts 34 are pivotally connected by pins 36 the loader boom arms 38. Each boom arm 38 extends forwardly and downwardly terminating in an end pivotally connected to the bucket or working tool 24. A boom cross member 40 extends transversely between the boom arms 38 spaced between the mast 18 and bucket 24 to provide lateral support for the boom arms 38. Pivotally attached to the rearward portion of each boom arm 38 is the ram end of a hydraulic lift cylinder 22. The base end of each hydraulic lift cylinder 22 is attached to the mast 18. A single hydraulic tilting cylinder 26 acts between the boom 20 and bucket 24, having its base end secured to the boom cross member 40. The ram end of the tilting cylinder 26 is pivotally connected to the bucket 24.

The loader 10 is mounted to and supported on the tractor 12 as hereinafter described in detail, by a first 42 and second 44 set of transversely spaced apart bracket means. These bracket means are provided for positioning the loader beneath and supporting it from the tractor and are designed to permit the loader to be mounted to any size tractor.

Cooperating with the bracket means 42 and 44 and necessary to the mounting or demounting sequence is a trunnion means 46. In the disclosed construction, loader base 16 mounted trunnion means 46 in the form of trunnions or pivot pins 48 are receivably positioned in trunnion supports 50 that depend from the tractor main frame. When the pivot pins 48 are supported in the trunnion support 50, there is provided a pivotal axis about which the loader frame is rotated between the demounted tilted position shown in FIG. 2 and the horizontally mounted position illustrated in FIG. 3.

Figure 7:
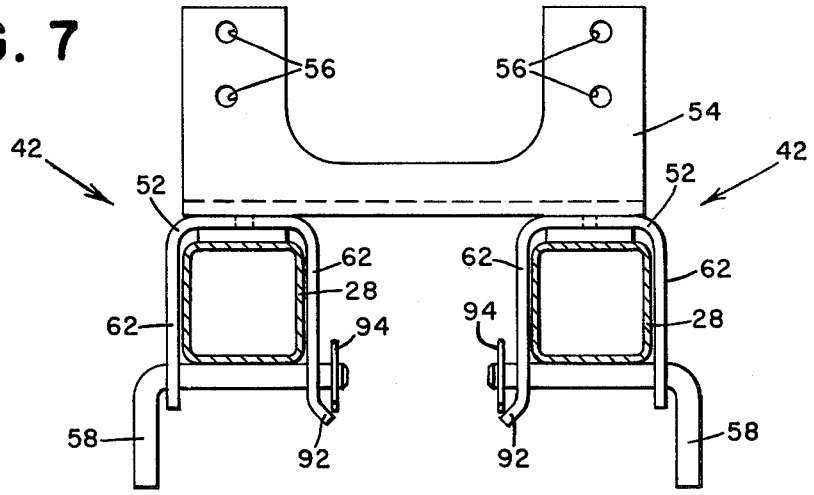
FIG. 7 is an enlarged fragmentary cross section taken along lines A—A and illustrating the loader forward frame sections fastened in the front mounting bracket.
Figure 8:
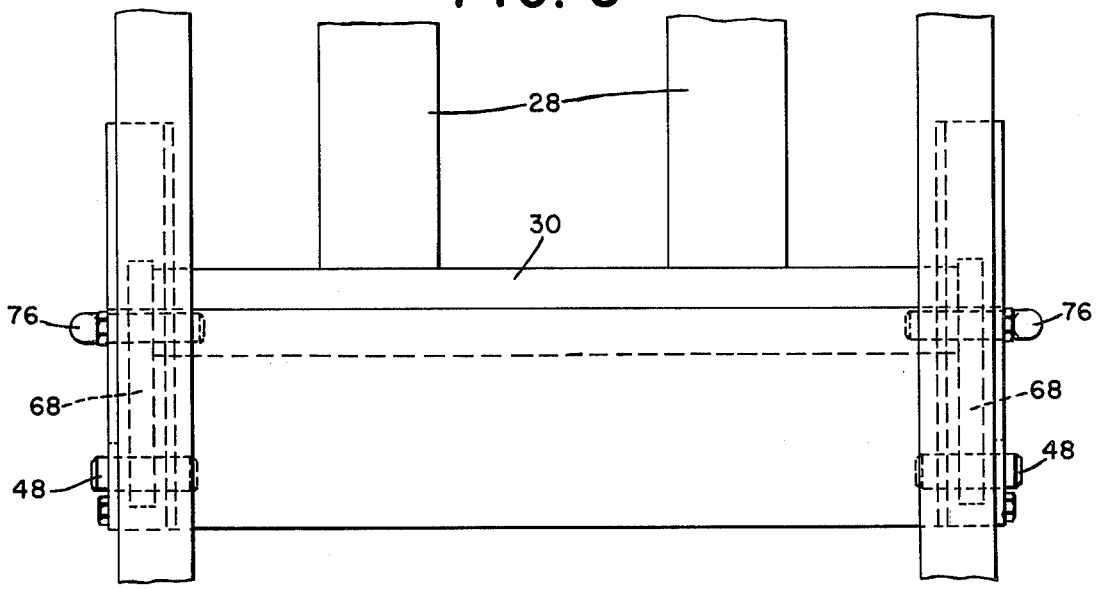
FIG. 8 is an enlarged fragmentary top view taken along lines B—B and illustrating the rear bracket positioning and fastening means.
Figure 9:
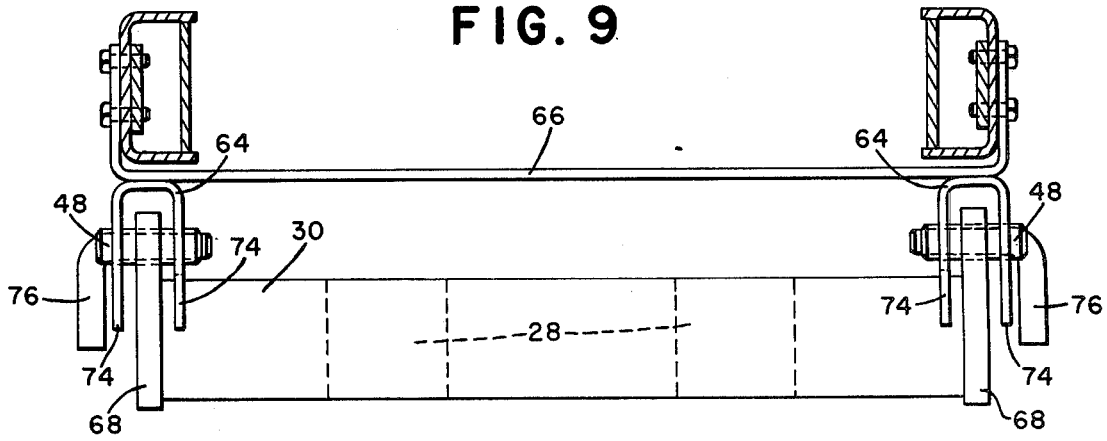
FIG. 9 is an enlarged fragmentary rear view taken along lines C—C and illustrating the rear bracket positioning and fastening means.

In the disclosed construction, the first bracket means 42 includes a pair of U-shaped downwardly and fore-and-aft opening brackets 52 provided with means for releasably fastening the loader to the tractor (see FIG. 7). Each bracket 52 is secured to a tractor mounted plate 54 which can be adapted to fit any size tractor. The plate is attached to the tractor with bolts 56 or other suitable means. Receivably positioned in each bracket 52 as the loader is elevated into a tractor-mounted position, is its respective base member 28. To secure the base member 28 within the bracket 52, removable pins 58 are inserted through apertures 60 in each opposite leg 62 of the bracket 52 (see FIG. 7). These first bracket means 42 not only position and support the loader forward end but also serve as a fulcrum about which the rearward loader base frame is rotated into position to be fastened after the frame base forward portion is fastened.

The second bracket means 44 includes a pair of brackets 64 depending from a mounting plate 66 bolted to the tractor main frame rearwardly of the first bracket means 42. That mounting plate 66 can also be adapted to permit the loader to be mounted on any size tractor.

From each side of the mounting plate 66 depends a U-shaped downwardly and fore-and-aft opening bracket 64 provided with means for releasably fastening the loader to the tractor. To each end of loader's rearwardmost cross member 30 are secured fore-and-aft extending and generally triangularly-shaped bracket plates 68 adapted to be receivably positioned within their respective depending bracket 64. Located above the cross member 30 in each bracket plate 64 are openings 70 compatible with openings 72 in each leg 74 of the bracket 64. Removable pins 76 are positioned within the openings 70 and 72 to secure each triangularly-shaped plate 68 in its respective bracket after the loader base rear is elevated into its bracket 64 and the openings 70 and 72 are aligned.

To assist in mounting and demounting the loader from the tractor, the trunnion means 46 is provided between the rearward portion of each base member 28 and the tractor. Provided as a part of the second bracket means 44 is the trunnion support 50 or shelf 78 having a U-shaped and upwardly opening cradle 80. Receivably positioned upon this shelf 78 during the mounting and demounting sequence are the pivot pins 48 which are transversely secured to their respective plate 68. Each pin 48 is secured to its plate 68 rearwardly of and horizontal with the openings 70 wherein the removable pins 76 are positioned. In this location, the pivot pin 48 can be easily positioned on the shelf 78 as the tractor is slowly advanced over the loader during the mounting sequence. The brackets 64 further include vertically elongated openings 82 extending upwardly from the cradle 80 to permit vertical movement of the pivot pin 48 between the cradle 80 and the upper portion of the elongated opening 82.

The method by which the loader is transfered between parked and tractor mounted positions is illustrated by the sequence of steps shown in FIGS. 1; 2 and 5; and 3, 6 and 7. In FIG. 1, the loader is shown in a parked, demounted storage position with the bucket 24 resting on the ground. The boom arms 38 are tilted downwardly and the bucket 24 tilted to allow the bucket surface 84 to rest level on the ground. Because the loader center of mass is located forwardly of the base frame forward ends, the bucket 24 must rest on the ground to provide a stable storage configuration. As is apparent from the drawings, no stand or storage rack is required to store the loader.

Figure 5:
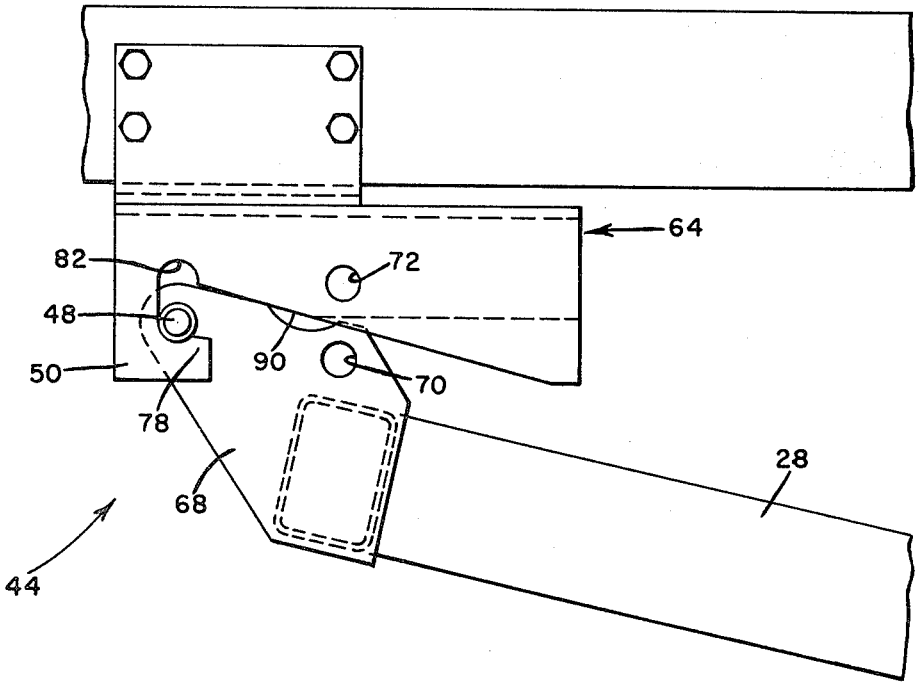

To mount the loader onto the tractor in the underslung fashion illustrated, the operator first drives the tractor over the parked loader aligning the loader pivot pins 48 with their respective trunnion support shelves 78 on the tractor. The hydraulic fluid supply lines 86 are then connected with the tractor. The loader is then pivoted about the forward end 88 of the base members to the position shown in FIG. 2. To pivot the loader to this position, the operator slowly extends the lift cylinder 22 to raise the bucket 24 from the ground or reduce the force exerted on the ground by the bucket. Because the loader center of mass is located forwardly of the base members forward end 88, the loader will slowly rotate to the position shown in FIG. 2. When the pivot pins 48 have been elevated sufficiently, the operator inches the tractor ahead to receivably guide the pins 48 along edge structure 90 and position the pins 48 in the elongated slot 82 as shown in FIGS. 2 and 5. With the pivot pin 48 positioned above the shelf 78, the operator next retracts the lift cylinder 22 to rotate the base members rear portion downwardly and seat the pin 48 in the cradle 80. As the operator continues to retract the lift cylinder 22, the loader will rotate about the pivot pin 48 which is supported on the shelf 78 and the frame base members 28 will be guided by flanges 92 into the U-shaped brackets 52 at the forward end of the tractor. The removable pins 58 are then inserted through the openings 60 to releasably fasten the loader forward portion within the brackets 52 and cotter pins 94 are inserted through the pins 58 to hold them in place.

The openings 70 in plates 68 are next aligned with those openings 72 in the second brackets 64. To raise the loader frame rear base portion, the operator will extend the lift cylinder 22 to cause the loader frame to rotate about the forward pins 58 and the pivot pin 48 to move to the upper portion of the elongated opening 82. Pins 76 are then inserted through the openings 70 and 72 to releasably fasten the plate 68 to the bracket 64.

To detach or demount the loader from the tractor requires that the operator follow the converse sequence of steps or order of procedure. The lift cylinder 22 is first extended to cause the loader rear portion to rotate upwardly. The rear pins 76 are then removed. The lift cylinder 22 is then retracted to cause the loader rear portion to rotate downwardly and the pivot pins 48 to seat in the cradles 80. With the rearward end of the loader supported on the bracket shelf 78 and the forward portion of the loader frame raised off the forward pins 58, the forward pins 58 are removed. The operator next extends the lift cylinder 22 to permit the base member forward end to be lowered to the ground as shown in FIG. 2. Next the lift cylinder 22 is extended to cause the pivot pins 48 to raise out of the cradle 80. The operator then backs the tractor up a few inches until the pivot pins 48 are clear of the support 50 and then retracts the lift cylinder 22 to return the base members to the position shown in FIG. 1. The hydraulic hoses 86 are then disconnected and the loader is in a stable position to be stored for either short or long periods.

From the foregoing, it is clear that the loader can be quickly mounted and demounted in a brief period with little manual exertion by the tractor operator. The tractor can be used for other purposes while the loader sits idle in a parked position.

We claim:

1. A detachable power loader for use on a tractor having a main frame structure including front and rear wheel support, said loader having a fore-and-aft elongated frame including a rectangularly-shaped base having front and rear ends and adapted to rest level with and on the ground when said loader is in a self-supported parked position, and be secured in underslung relation to the tractor main frame structure when in a tractor-mounted position, said frame further having upstanding side members projecting upwardly and rearwardly from the front end of the base and to be on opposite sides of said tractor when said loader is in a tractor-mounted position; a forwardly extending lift boom pivotally connected with the upper portion of each side member; power means between said boom and frame for swingably moving said boom relative to said frame; a working tool on the outer end of said boom; first bracket means attached to the tractor main frame structure adjacent the front wheel support and including a downwardly opening portion for receiving a portion of said loader base spacedly rearwardly of its front end; means for releasably fastening said loader base with said first bracket means; trunnion means secured to the rear end of said base; second bracket means attached to the tractor main frame structure rearward of the first bracket means, the second bracket means having a forward downwardly opening portion for receiving the trunnion means and a rear trunnion means supporting portion that receives the trunnion means from the front portion; means for releasably fastening the rear end of said loader base when the trunnion means are in the rear trunnion means supporting portion; said loader having a center of mass located forwardly of said frame base member.

2. The invention defined in claim 1 wherein the first bracket means includes a fore-and-aft downwardly opening U-shaped member having a pin receiving means, the portion of said loader base is a fore-and-aft beam receivable in the U-shaped member, and said means for releasably fastening the first bracket means to the loader base portion is a removable pin receivable in said openings.

3. The invention defined in claim 1 wherein the base includes a pair of transversely spaced fore-and-aft members and said second bracket means being a pair of fore-and-aft extending downwardly opening U-shaped brackets for receiving the members, the brackets and members having transversely registrable openings therein and said means for releasably fastening the rear end of said loader base to said bracket are pins receivable in said openings when the latter are in registry.

4. The invention defined in claim 1 wherein the transverse trunnion means includes a transversely projecting pivot pin secured to the rear portion of said loader base and receivable in the forwardly opening portion and rear trunnion supporting portion of the second bracket means.

5. The invention defined in claim 4 wherein the trunnion supporting portion of the second bracket means includes an upwardly opening U-shaped cradle for receiving the pivot pin.

6. The invention defined in claim 5 further characterized by the trunnion supporting portion having a vertically elongated opening extending upwardly from the cradle for permitting vertical movement of the pivot pin from the cradle to the upper portion of the opening, and by the loader base and second bracket means having openings therein registrable only upon the pivot pins being in the upper portions of the elongated openings, and in which the releasable fastening means is a pin receivable in the registrable opening.

7. A detachable power loader for use on a tractor having a main frame structure including front and rear wheel support, said loader having a fore-and-aft elongated frame including a rectangularly-shaped base with fore-and-aft extending members and having front and rear ends and adapted to rest level with and on the ground when said loader is in a self-supported parked position, and be secured in underslung relation to the tractor main frame structure when in a tractor-mounted position, said frame further having upstanding side members rigidly projecting upwardly and rearwardly from the front end of the base and to be on opposite sides of said tractor when said loader is in a tractor-mounted position; a forwardly extending lift boom pivotally connected with the upper portion of each side member; power means between said boom and frame for swingably moving said boom relative to said frame; a working tool on the outer end of said boom; a first bracket means including a first pair of fore-and-aft extending downwardly opening U-shaped members attached to the tractor main frame structure adjacent the front wheel support, each member having a pin receiving means; said loader frame base including fore-and-aft extending members adapted to be receivable in the respective U-shaped members; removable pins receivable in each of said U-shaped member's pin receiving means for releasably fastening each loader base fore-and-aft extending member in its respective U-shaped member; transversely projecting pivot pins secured to the rear end of said loader base; a second bracket means attached to the tractor main frame structure rearward of the first bracket means, including a second pair of fore-and-aft extending downwardly opening U-shaped members for receiving the loader base fore-and-aft extending members, said U-shaped member and base fore-and-aft extending members having transversely registrable openings therein; removable pins receivable in said transversely registrable openings for fastening said fore-and-aft extending members to said second pair of said U-shaped members; said second bracket means further including a forward downwardly opening pivot pin supporting portion having an upwardly opening U-shaped cradle for receivingly supporting pivot pins, said pivot pin supporting portion further characterized in that it has a vertically elongated opening extending upwardly from the cradle for permitting vertical movement of the pins from the cradle to the upper portion of the opening; with said loader having a center of mass located forwardly of said loader base.

8. A detachable power loader for use on a tractor having a main frame structure including front and rear wheel support, said loader having a fore-and-aft elongated frame including a rectangularly-shaped base having front and rear ends and adapted to rest level with and on the ground when said loader is in a self-supported parked position, and be secured in underslung relation to the tractor main frame structure when in a tractor-mounted position, said frame further having upstanding side members rigidly projecting upwardly and rearwardly from the front end of the base and to be on opposite sides of said tractor when said loader is in a tractor-mounted position; a forwardly extending lift boom pivotally connected with the upper portion of each side member; power means between said boom and frame for swingably moving said boom relative to said frame; a working tool on the outer end of said boom; first mounting structure between the forward portions of said tractor and base including a fore-and-aft extending vertically opening U-shaped forward bracket secured to one forward portion and a fore-and-aft extending member on the other portion adapted to be receivably positioned in the opening of said U-shaped forward bracket; means for releasably fastening the fore-and-aft extending member in said bracket opening; second mounting structure between the rear portions of said tractor and base including a fore-and-aft extending vertically opening U-shaped rear bracket secured to one rear portion and a fore-and-aft extending member on the other portion receivable in said rear bracket; means for releasably fastening the fore-and-aft extending member in the rear bracket opening; trunnion means between the rear bracket and fore-and-aft extending member on the other rear portion including a pivot pin and a pivot pin receiving and support means; and said loader having a center of mass located forwardly of said loader frame base member.

* * * * *